US006563930B1

(12) United States Patent
Nakamura et al.

(10) Patent No.: US 6,563,930 B1
(45) Date of Patent: May 13, 2003

(54) SPEAKER

(75) Inventors: Takeshi Nakamura, Ull (JP); Takayuki Kaneko, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/055,551

(22) Filed: Apr. 6, 1998

Related U.S. Application Data

(63) Continuation-in-part of application No. 08/760,639, filed on Dec. 4, 1996, now Pat. No. 5,802,196.

(30) Foreign Application Priority Data

Dec. 27, 1997 (JP) ..... 9-368133

(51) Int. Cl.[7] ..... H04R 25/00
(52) U.S. Cl. ..... 381/190
(58) Field of Search ..... 381/190, 163, 381/173, 178, 182, 373, 386, 430; 301/311, 800, 322, 324; 181/161, 173, 199

(56) References Cited

U.S. PATENT DOCUMENTS 4,440,983 A * 4/1984 Facoetti et al. ..... 381/190
4,558,249 A * 12/1985 Lerch ..... 381/190
4,843,275 A * 6/1989 Radice ..... 381/190
4,866,683 A * 9/1989 Phillips ..... 381/190
5,309,519 A * 5/1994 Park et al. ..... 381/190
5,660,877 A * 8/1997 Venkatarmani et al. ..... 427/100
5,802,196 A * 9/1998 Nakamura ..... 381/202
5,825,902 A * 10/1998 Fujishima ..... 381/190
5,828,766 A * 10/1998 Gallo ..... 381/190
5,867,583 A * 2/1999 Hazelwood et al. ..... 381/386

FOREIGN PATENT DOCUMENTS

JP 9-23499 A 1/1997

* cited by examiner

*Primary Examiner*—Duc Nguyen
*Assistant Examiner*—Suhan Ni
(74) *Attorney, Agent, or Firm*—Keating & Bennett, LLP

(57) ABSTRACT

A speaker has a semi-spherical vibration section and a ringed plate-like base section. The vibration section and the base section are formed as a single, unitary piezoelectric body. Driving electrodes are located on the single unitary body comprising the vibration section and the base section. The driving electrodes are connected with lead electrodes and the lead electrodes are connected with connecting terminals.

9 Claims, 2 Drawing Sheets

SPEAKER

This Application is a Continuation-In-Part of U.S. patent application Ser. No. 08/760,639 filed Dec. 4, 1996 now U.S. Pat. No. 5,802,196.

BACKGROUND OF THE INVENTION

1. Field of the Invention

The present invention relates to a speaker including a substantially semi-spherical piezoelectric ceramic member and more particularly to a speaker which is constructed for use, for example, as a super-tweeter used in reproducing DVD audio or super-audio CDs.

2. Description of the Related Art

A piezoelectric ceramic speaker which is related to the speaker described and claimed herein is disclosed in U.S. patent application Ser. No. 08/760,639 which is the parent application of the present Continuation-In-Part Application. The speaker described in U.S. patent application Ser. No. 08/760,639 has a vibrating section made of a semi-spherical piezoelectric body and is constructed by connecting the vibrating section and a base section which sections are separately formed of different materials. The vibrating section is mounted on the base section with insulation materials located therebetween.

Because this related speaker is constructed by using an adhesive to connect the vibrating section and the base section which are separately formed of different materials, the manufacturing efficiency and the acoustic characteristics of the sound output thereby are not uniform or of high quality as is desired. Furthermore, a high harmonic mode of the semi-spherical piezoelectric body is generated as spurious in about half of a fundamental resonance frequency by profile vibration of the semi-spherical end surface. In addition, although the base section is required to have insulation material for accommodating connecting terminals, the base section often requires an increased thickness because the specific weight of the base section usually made of synthetic resin is too light which causes a draw or concave recess during molding of the base section.

SUMMARY OF THE INVENTION

To overcome the problems described above, the preferred embodiments of the present invention provide a speaker which is adapted and constructed to allow increased efficiency of manufacturing and substantially uniform and excellent acoustic characteristics of sound output thereby.

According to one preferred embodiment of the present invention, a speaker includes a semi-spherical vibrating section, driving electrodes for vibrating the vibrating section, and a base section for holding the vibrating section, wherein the vibrating section and the base section comprise a unitary, integral molded piezoelectric body.

When electrical signals are input to the driving electrodes, the vibrating section vibrates due to a piezoelectric effect and emits sound waves from the curved semi-spherical surfaces of the vibrating body in the inventive speaker according to the preferred embodiments of the present invention. Because of the semi-spherical shape of the vibrating body, sound waves are transmitted omnidirectionally and are not limited to only certain directional sound wave transmission as is common in prior art speakers.

Because the vibrating section and the base section are molded as a single unitary body of piezoelectric material, a step and material required for bonding the vibrating section and the base section to each other required in related speakers is eliminated. Thus, the number of parts and manufacturing and assembly steps are reduced and ease and efficiency of fabrication is increased. Further, with the novel structure of the preferred embodiments of the present invention, profile vibration in the high order mode is suppressed because of the unitary construction of the vibrating section and the base section, thereby improving the acoustic characteristics of the speaker.

It is preferable that the vibrating section and the base section are molded and formed such that a ratio of weight relative to each other is about 1:5 to about 1:20 for the purpose of improving the acoustic characteristics of the speaker. More specifically, the inventor of the present application determined that acoustic characteristics of the inventive speaker are greatly improved when an outline vibration mode of the semi-spherical surfaces of the vibrating body is suppressed as much as possible. The inventor also determined that the outer edges of the curved semi-spherical surfaces of the vibrating body should be fixed to suppress the outline vibration mode of the vibrating body. However, the inventor discovered that when the outer edges of the curved semi-spherical surfaces of the speaker body are fixed to a support member such as a speaker box, for example, and the base section of the speaker vibrates, the acoustic characteristics of the speaker are changed. This problem of changing speaker acoustic characteristics is solved and uniform high quality acoustic characteristics are achieved by molding the vibrating section and the base section such that a ratio of weight relative to each other is about 1:5 to about 1:20.

In addition, it is preferable to dispose the driving electrodes on a surface of the vibrating section and to have a portion of the driving electrodes extend onto the base section. As a result of this arrangement of the driving electrodes, it is easier to connect the electrodes with external circuits by extending the driving electrodes located on the surface of the vibrating section onto the base section.

It is also preferable to form mounting notches or holes in the base section to allow the speaker to be attached to a support member such as a case or box.

These and other elements, features, and advantages of the preferred embodiments of the present invention will be apparent from the following detailed description of preferred embodiments of the present invention, illustrated in the accompanying drawings.

DETAILED DESCRIPTION OF PREFERRED EMBODIMENTS

Figure 1:
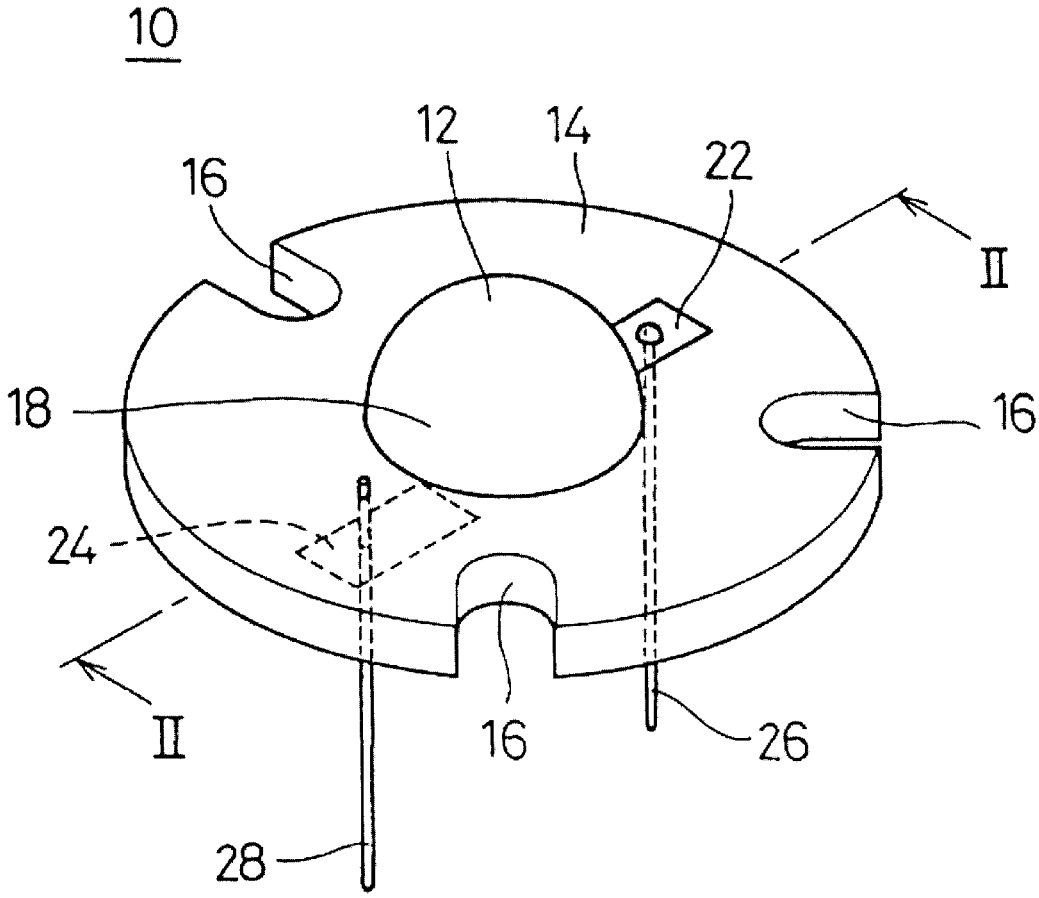
FIG. 1 is a perspective view showing one example of a preferred embodiment of a speaker according to the present invention.
Figure 2:
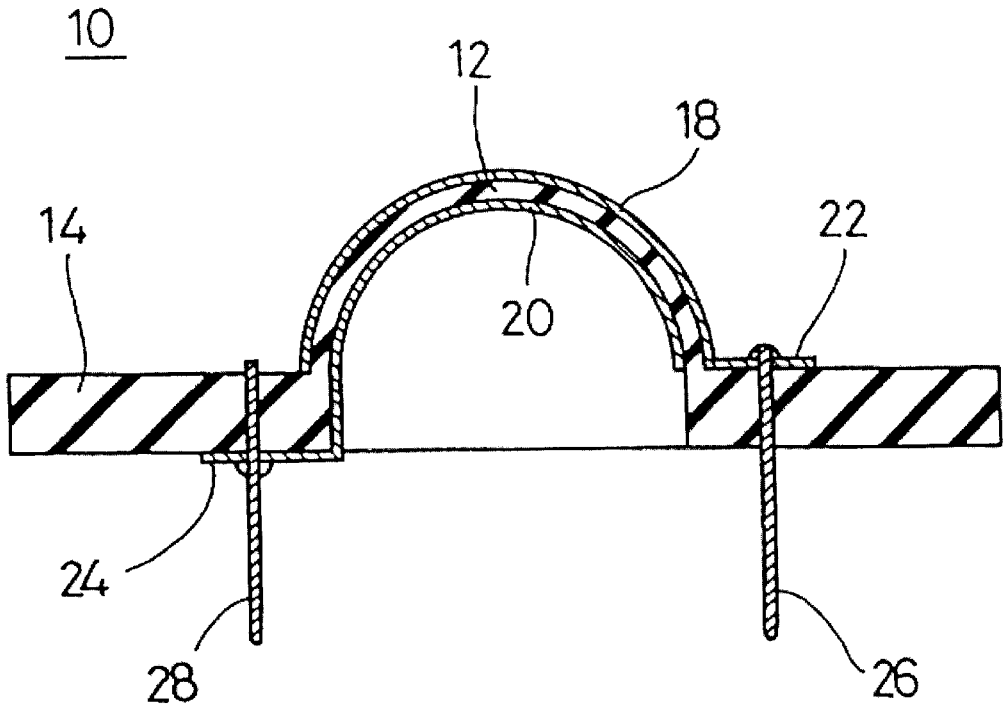
FIG. 2 is a section view along line II—II in FIG. 1.

Preferred embodiments of the present invention are shown in FIG. 1 which is a perspective view of a speaker according to a preferred embodiment of the present invention and also shown in FIG. 2 which is a section view along line II—II in FIG. 1.

A speaker 10 shown in FIG. 1 includes a semi-spherical vibrating section 12. The vibrating section 12 is polarized in the direction of its thickness, for example. A ringed plate-like base section 14 is formed at the edge portion of the vibrating section 12 in a single, unitary body construction. The vibrating section 12 and the base section 14 are preferably formed so that the ratio of their respective weights relative to each other is about 1:5 to about 1:20.

In one example, the vibrating section 12 is preferably formed to have a size of about 20 mm in diameter and about 0.5 mm in thickness and the base section 14 is preferably formed to have a size of about 60 mm in diameter and about 5 mm in thickness.

Mounting notches or recesses 16 are preferably created in the circumferential direction of the outer edge portion of the base section 14, for example, at a plurality of locations at predetermined intervals at the same time when the base section 14 is molded. The mounting notches 16 make it easy to fix the base section 14 to a separate support member such a case or support stand. The speaker can be fixed to such support member by fixing members such as screws (not shown). It is noted that the shape and location and number of the mounting notches 16 is not limited to that shown in FIG. 1. For example, it is possible to create through holes of any shape in the base section 14 for functioning as mounting holes 16.

In a preferred method of manufacturing the speaker according to the preferred embodiments of the present invention, the vibrating section 12 and the base section 14 are press-molded or injection-molded using a piezoelectric body such as ceramic and by sintering thereafter. During this manufacturing step, the notches 16 can be formed. Once the single unitary body including the vibrating section 12, the base section 14 and the notches 16 (if desired) is formed, the electrodes can be added as described below.

A driving electrode 18 for vibrating the vibrating section 12 is disposed on the curved outer surface of the semi-spherical vibrating section 12 and a driving electrode 20 is disposed on the inner surface of the semi-spherical vibrating section 12. That is, the driving electrode 18 and the driving electrode 20 are arranged so as to face each other with the vibration section 12 being located therebetween in a thickness direction thereof. Further, one end of a strip lead electrode 22 is connected to the driving electrode 18 and the other end thereof is extended on the surface of the base section 14. Similarly, one end of a strip lead electrode 24 is connected to the driving electrode 20 and the other end thereof is extended onto the back of the base section 14.

The driving electrodes 18 and 20 and the lead electrodes 22 and 24 of the present preferred embodiment preferably have a double-layer structure, respectively. A Ni layer is preferably formed as the underlying layer and an Au layer is preferably laminated on the Ni layer as a finishing layer. The driving electrodes 18 and 20 and the lead electrodes 22 and 24 are preferably formed by plating, sputtering, evaporation or printing after masking a portion where no electrode is to be formed.

The speaker lo also includes connecting terminals 26 and 28 each preferably comprising a metallic pin. The connecting terminals 26 and 28 are attached respectively so as to penetrate through the base section 14 in the thickness direction thereof. Then, the connecting terminal 26 is electrically connected and fixed to the lead electrode 22 and the connecting terminal 28 is electrically connected and fixed to the lead electrode 24. The connecting terminals 26 and 28 are connected with the lead electrodes 22 and 24 by soldering, for example, or other connection devices or techniques.

Because the vibrating section 12 and the base section 14 comprise a single unitary molded piezoelectric body, there is no step or material required for bonding the vibrating section 12 the base section 14. Thus, this reduces the parts and steps required for manufacturing the speaker and increases the quality of the acoustic characteristics of the speaker. In addition, forming the vibrating section 12 and the base section 14 to have a ratio of weight of about 1:5 to about 1:20, the acoustic characteristics of the speaker are further improved. In addition, due to the single molded unitary piezoelectric body including the vibrating section 12 and base section 14, the profile vibration in the high order mode is suppressed. The fabrication of the speaker is further facilitated because the construction of the preferred embodiments of the present invention allow the driving electrodes 18 and 20 and the lead electrodes 22 and 24 to be formed at the same time via a plating step or similar process. Because the lead electrodes 22 and 24 are extended onto the base section 14, the vibration is not suppressed as often occurs in the prior art in which lead wires are connected directly to the vibrating section 12. Because the lead electrodes 22 and 24 and the connecting terminals 26 and 28 are formed in the speaker 10, it is easy to connect the electrodes 22, 24, 26 and 28 to external circuits (not shown). In addition, because mounting notches 16 are formed in the base section 14 in the speaker 10, the speaker 10 is easily attached to a support member.

As described above, according to the preferred embodiments of the present invention, the vibrating section and the base section are molded into a single unitary body of piezoelectric material so that it is not required to connect the vibrating section and the base section as is required with other speakers. In addition, the number of parts and steps required to assemble the speaker is reduced and the costs of manufacturing are significantly reduced. Further, because of the vibrating section and the base section being a molded unitary piezoelectric body, the profile vibration in the high order mode is significantly reduced and the acoustic characteristics of the speaker are greatly improved.

While the invention has been particularly shown and described with reference to the preferred embodiments thereof, it will be understood by those skilled in the art that the foregoing and other changes in form and details may be made thereto without departing from the spirit and scope of the invention.

What is claimed is:

1. A speaker, comprising:

a substantially semi-spherical vibrating section defined by a rigid substantially semispherical body having a substantially semispherical inner surface and a substantially semispherical outer surface;

a plurality of driving electrodes for vibrating said vibrating section, a first of the plurality of driving electrodes being provided on and supported by the substantially semispherical inner surface of the rigid substantially semispherical body so as to conform to the shape of the substantially semispherical inner surface of the rigid substantially semispherical body and a second of the plurality of driving electrodes being provided on and supported by the substantially semispherical outer surface of the rigid substantially semispherical body so as to conform to the shape of the substantially semispherical outer surface of the rigid substantially semispherical body; and a base section for supporting said vibrating section; wherein said vibrating section and said base section comprise a single unitary molded sintered piezoelectric ceramic body.

2. The speaker according to claim 1, wherein said plurality of driving electrodes are located on the surface of said vibrating section and a portion of said driving electrodes extend onto said base section.

3. The speaker according to claim 1, wherein a plurality of mounting notches are provided in said base section for allowing said speaker to be supported on a support member.

4. The speaker according to claim 1, wherein said vibrating section and said base section have a weight ratio relative to each other of about 1:5 to about 1:20.

5. The speaker according to claim 1, wherein said vibrating section is polarized in a thickness direction thereof.

6. A speaker comprising:

a substantially semi-spherical vibrating section;

a plurality of driving electrodes for vibrating said vibrating section;

a base section for supporting said vibrating section; wherein said vibrating section and said base section comprise a single unitary molded sintered piezoelectric ceramic body; and said plurality of driving electrodes comprises a first driving electrode provided on an outside surface of said vibrating section, and a second driving electrode provided on an inner surface of said vibrating section, said first driving electrode extends onto said base section only at one side of said vibrating body, and said second driving electrode extends onto said base section only at another side of said vibrating section which is opposite to said one side of said vibrating section.

7. The speaker according to claim 3, wherein said plurality of mounting notches comprises three notches which are equally spaced around the circumference of said base section.

8. The speaker according to claim 1, further comprising a plurality of connecting terminals, each of said plurality of connecting terminals being connected to a respective one of said plurality of driving electrodes, wherein each of said plurality of connecting terminals extends through said base section.

9. A speaker comprising:

a substantially semi-spherical vibrating section;

a plurality of driving electrodes for vibrating said vibrating section;

a base section for supporting said vibrating section; wherein said vibrating section and said base section comprise a single unitary molded sintered piezoelectric ceramic body; and said base section of said single unitary molded sintered piezoelectric ceramic body has a thickness that is substantially greater than a thickness of said vibrating section of said single unitary molded sintered piezoelectric ceramic body.

* * * * *